US008105227B2

(12) United States Patent
Hubbard et al.

(10) Patent No.: US 8,105,227 B2
(45) Date of Patent: Jan. 31, 2012

(54) PRESSURE REDUCING FOLDING SYSTEM

(75) Inventors: Richard Hubbard, Bedfordshire (GB); Mike Snelling, Bedfordshire (GB); Jeff Ryan, Hertfordshire (GB); Ian Parks, Hertfordshire (GB); Chris Pearce, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 247 days.

(21) Appl. No.: 12/432,153

(22) Filed: Apr. 29, 2009

(65) Prior Publication Data

US 2010/0278577 A1 Nov. 4, 2010

(51) Int. Cl.
*B31F 1/10* (2006.01)

(52) U.S. Cl. ..... 493/444; 493/434; 493/437; 493/445; 270/49

(58) Field of Classification Search ..... 493/424, 493/434, 435, 437, 442, 444, 445; 270/49
See application file for complete search history.

(56) References Cited

U.S. PATENT DOCUMENTS 3,954,258 A * 5/1976 Skipor et al. ..... 493/445
5,169,376 A * 12/1992 Ries et al. ..... 493/445
6,568,668 B1 * 5/2003 Wakabayashi et al. .... 270/58.11
6,939,283 B2 * 9/2005 Sparano et al. ..... 493/424
7,871,065 B2 * 1/2011 Fukasawa et al. ..... 270/37
2008/0182740 A1 7/2008 Fukasawa et al.
2008/0318752 A1 12/2008 Oshiro et al.
2009/0200724 A1 8/2009 Iguchi et al.

OTHER PUBLICATIONS

European Search Report Issued Jun. 16, 2010 in Connection with Related EP Application No. 10160522.8.

* cited by examiner

*Primary Examiner* — Thanh Truong
(74) *Attorney, Agent, or Firm* — Stuart I. Smith; Prass LLP

(57) ABSTRACT

A device for folding sheets of a medium is provided. The device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; and a crease blade for contacting the sheets to create a crease in the sheets. Rotation of the cam mechanism through a first period of rotation causes the crease blade to move in a contact direction to create the crease in the sheets by pushing the sheets between the first rolls. Rotation of the cam mechanism through a second period of rotation causes the crease blade to move in a retracting direction away from the sheets and causes the lever to move the first and second scissor arms such that the first pair of rolls is separated and the second pair of rolls is separated.

14 Claims, 7 Drawing Sheets

PRESSURE REDUCING FOLDING SYSTEM

BACKGROUND

Disclosed herein is a system and method for reducing the pressure applied to a stack of printed pages during a folding process.

An example of an application for a system for reducing the pressure applied to a stack of printed pages is a photocopier or printer that produces folded booklets.

In some booklet making systems, pressure is applied to the fold nip as the folded booklet is passed through. With warm solid inks, for example, "blocking" or image transfer can occur if the folded set is passed through a high pressure nip. This blocking or image transfer is undesirable.

SUMMARY

A device for folding sheets of a medium is provided. The device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; and a crease blade for contacting the sheets to create a crease in the sheets. Rotation of the cam mechanism through a first period of rotation causes the crease blade to move in a contact direction to create the crease in the sheets by pushing the sheets between the first rolls. Rotation of the cam mechanism through a second period of rotation causes the crease blade to move in a retracting direction away from the sheets and causes the lever to move the first and second scissor arms such that the first pair of rolls is separated and the second pair of rolls is separated.

DETAILED DESCRIPTION

Figure 1:
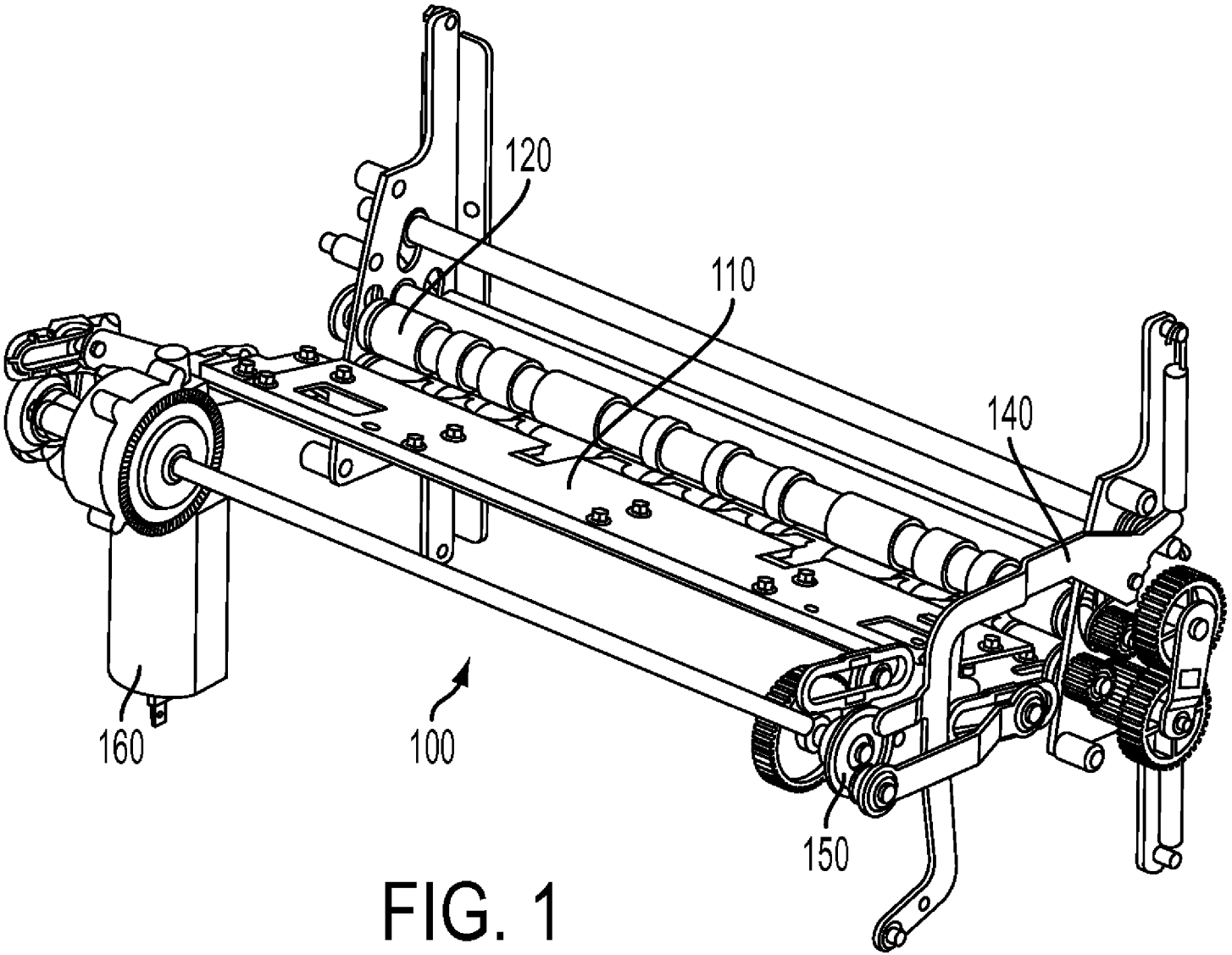
FIG. 1 is a diagram of an exemplary folding system in accordance with one possible embodiment of the disclosure.

Aspects of the embodiments disclosed herein relate to a system and method for folding sheets of a printed medium. For example, a saddle stitching booklet maker system can use embodiments of the disclosure to produce booklets with little or no image transfer or blocking.

The disclosed embodiments may include a device for folding sheets of a medium. The device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; and a crease blade for contacting the sheets to create a crease in the sheets. Rotation of the cam mechanism through a first period of rotation causes the crease blade to move in a contact direction to create the crease in the sheets by pushing the sheets between the first rolls. Rotation of the cam mechanism through a second period of rotation causes the crease blade to move in a retracting direction away from the sheets and causes the lever to move the first and second scissor arms such that the first pair of rolls is separated and the second pair of rolls is separated.

The disclosed embodiments may further include a printing device. The printing device has a medium storage area; a folding device for folding sheets of a medium being printed; and a controller that controls rotation of a cam mechanism. The folding device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; and a crease blade for contacting the sheets to create a crease in the sheets. Rotation of the cam mechanism through a first period of rotation causes the crease blade to move in a contact direction to create the crease in the sheets by pushing the sheets between the first rolls. Rotation of the cam mechanism through a second period of rotation causes the crease blade to move in a retracting direction away from the sheets and causes the lever to move the first and second scissor arms such that the first pair of rolls is separated and the second pair of rolls is separated.

The disclosed embodiments may further include a method for folding sheets of a medium. The method includes rotating a cam mechanism through a first period of rotation to cause a crease blade to move in a contact direction to create a crease in the sheets by pushing the sheets between a pair of first rolls, and rotating the cam mechanism through a second period of rotation to cause the crease blade to move in a retracting direction away from the sheets and cause a lever to move first and second scissor arms such that the first pair of rolls is separated and a second pair of rolls is separated.

Figure 5:
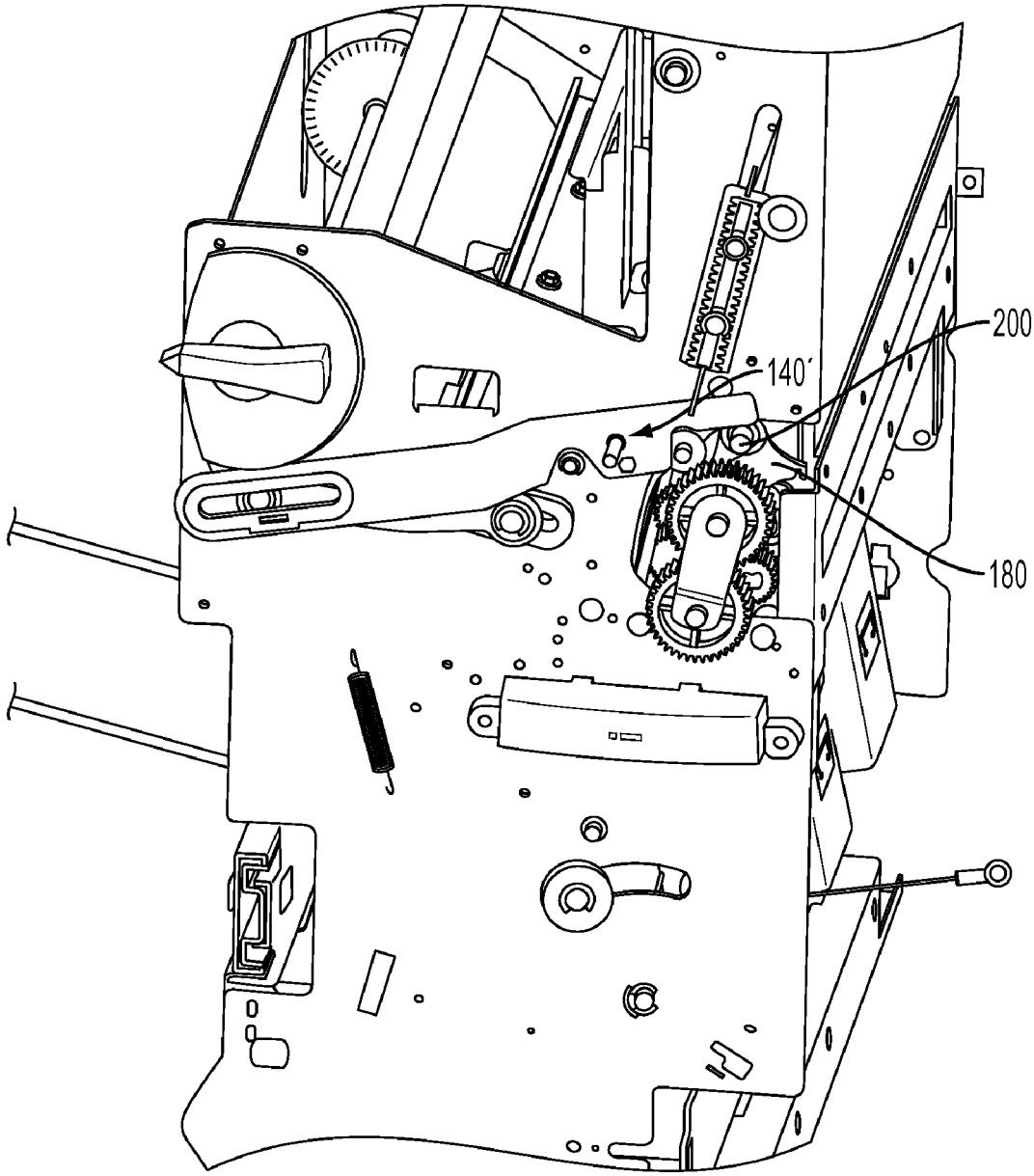
FIG. 5. is an exemplary diagram of a folding system in accordance with one possible embodiment of the disclosure.
Figure 6:
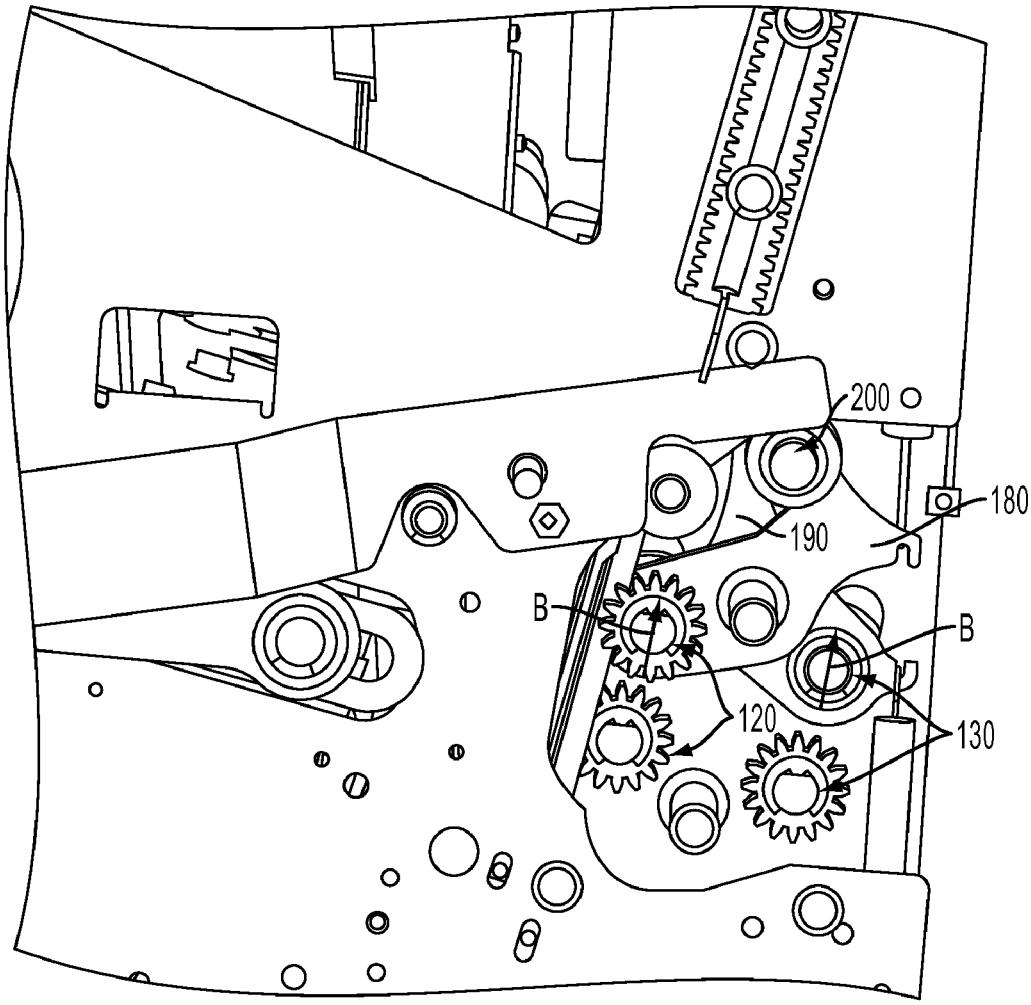
FIG. 6. is another view of the folding system shown in FIG. 5.

FIGS. 1-4 show a first exemplary embodiment of a system in accordance with the disclosure. FIGS. 5 and 6 show a second embodiment of a system in accordance with the disclosure.

FIG. 1 is a partial view of an example of a system using an embodiment of the disclosure. FIG. 1 shows an assembly 100 for producing a fold in a stack of printed pages. Assembly 100 has a crease blade 110 that creates a crease in the stack of printed pages. Crease blade 110 is moved toward a first pair of pressure rolls 120 to push the stack of printed pages into and between first pair of pressure rolls 120. A cam mechanism 150 actuates a lever 140 that, in turn, actuates a scissor arm that controls a gap between the first pair of pressure rolls 120. In this disclosure, a "cam" may be defined as a rotating or sliding piece in a mechanical linkage used to at least in part transform rotary motion into linear motion, for example. Lever 140 also actuates a scissor arm that controls a gap between a second pair of pressure rolls 130 (not shown in FIG. 1). In this disclosure, the term "scissor arm" may be defined as one of a pair of arms that are pivotably mounted relative to each other, for example. A drive motor 160 drives cam mechanism 150. A single motor 160 can be used to drive cam mechanism 150 and crease blade 110, or multiple motors can be used.

Figure 2:
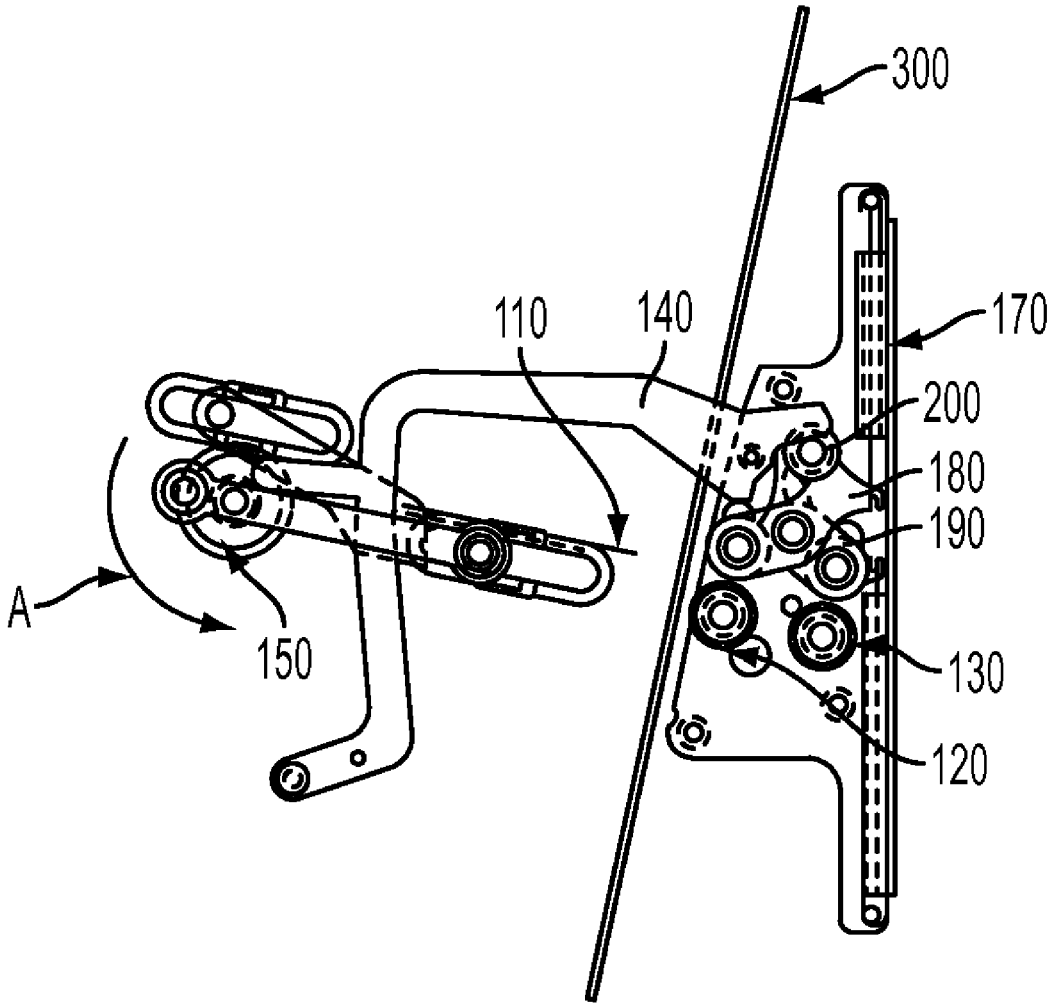
FIG. 2 is an exemplary diagram of a folding system in accordance with one possible embodiment of the disclosure at a first position.
Figure 3:
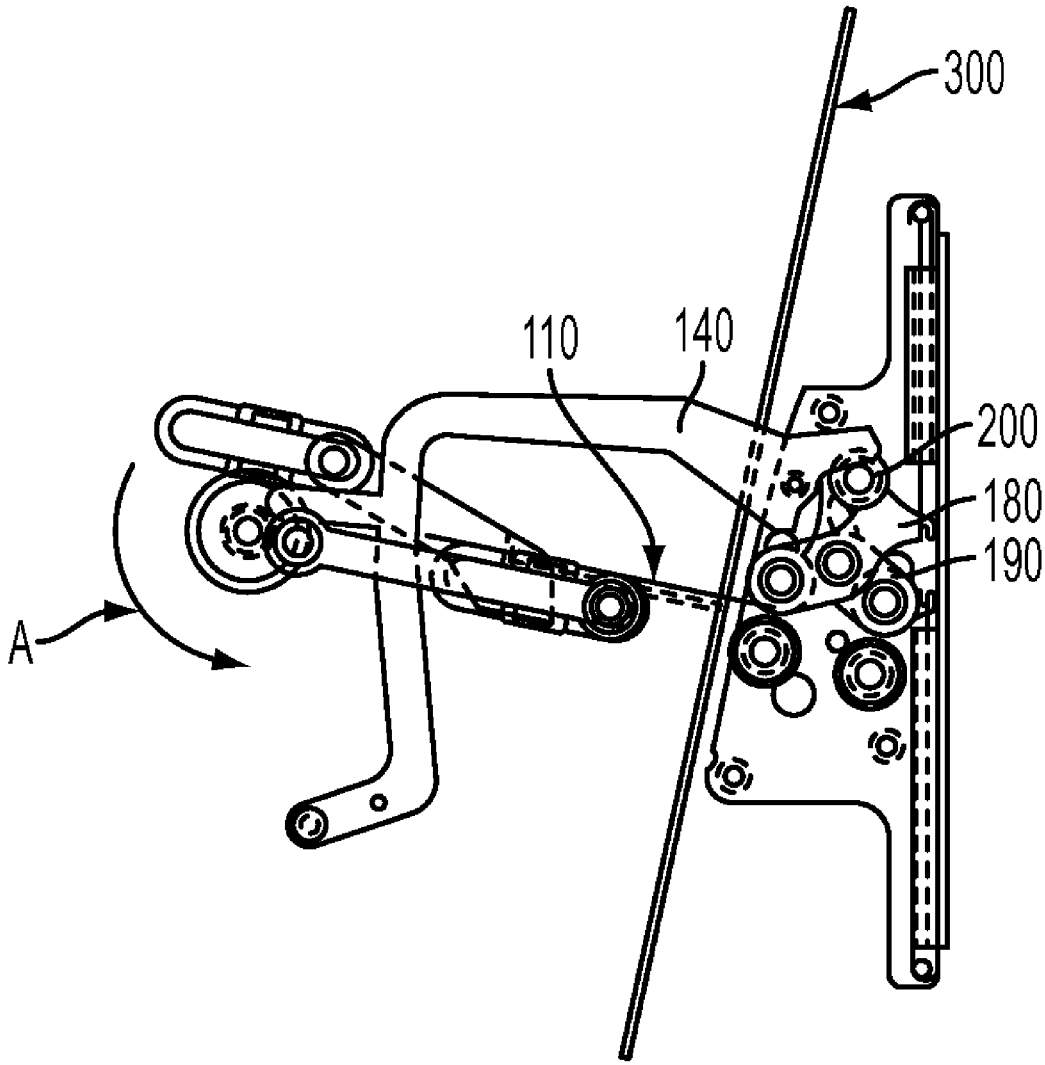
FIG. 3 is an exemplary diagram of a folding system in accordance with one possible embodiment of the disclosure at a second position.
Figure 4:
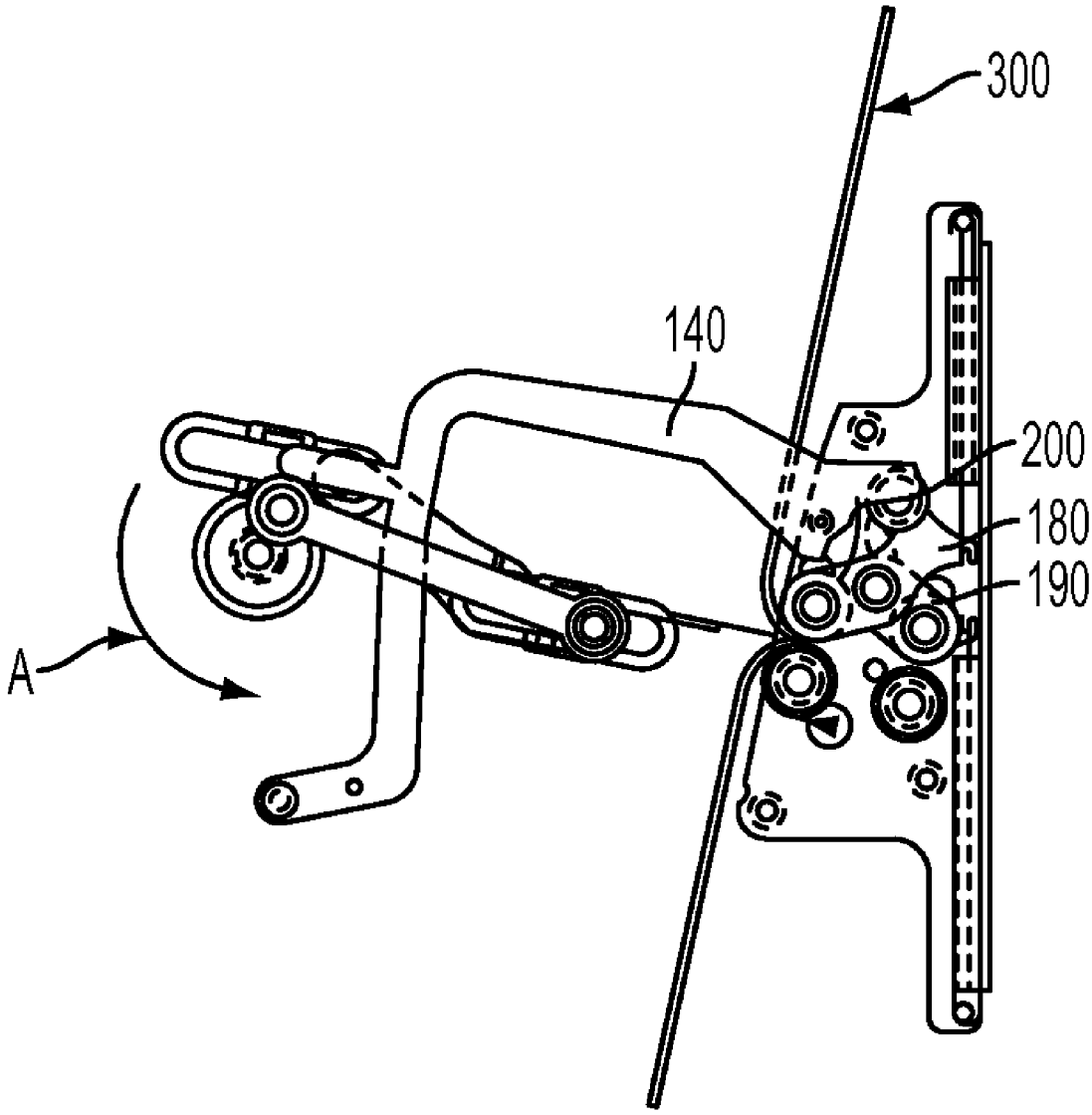
FIG. 4 is an exemplary diagram of a folding system in accordance with one possible embodiment of the disclosure at a third position.

FIGS. 2-4 show an example of the operation of Assembly 100.

FIG. 2 shows assembly 100 with crease blade 110 in the back position while sheets 300 are moved into position for folding. FIG. 2 shows second pair of pressure rolls 130 located downstream of first pair of pressure rolls 120. A first scissor arm 180 is attached to the upper roll of first pair of pressure rolls 120. A second scissor arm 190 is attached to the upper roll of second pair of pressure rolls 130. A pin 200 transfers motion from level 140 to scissor arms 180, 190. Springs 170 apply force to scissor arms 180, 190 that is in turn applied to pressure rolls 120, 130. As cam mechanism 150 rotates in the direction of arrow A, crease blade 110 moves toward sheets 300 to the position shown in FIG. 3.

FIG. 3 shows crease blade 110 in the forward position pushing sheets 300 into the nip between first pair of pressure rolls 120. As cam mechanism 150 continues to rotate in direction A, lever 140 is moved such that downward force is applied to pin 200. As pin 200 is pushed downward in FIG. 3, first scissor arm 180 rotates to lift the upper roll of first pair of pressure rolls 120 and, as a result, decrease the pressure applied to sheets 300. Similarly, as pin 200 is pushed downward in FIG. 3, second scissor arm 190 rotates to lift the upper roll of second pair of pressure rolls 130 and, as a result, decrease the pressure applied to sheets 300 as they progress through second pair of pressure rolls 130. In one embodiment, the upper roll of first pair of pressure rolls 120 is lifted after crease blade 110 is inserted approximately 5 to 6 mm into the nip. By decreasing the pressure applied to sheets 300 by the pressure rolls, blocking can be reduced or eliminated. By allowing crease blade 110 to be inserted into the nip for a short distance before reducing the pressure applied by the pressure rolls, a satisfactory fold can be achieved with little or no blocking.

The timing of the pressure reduction at second pair of pressure rolls 130 relative to the pressure reduction at first pair of pressure rolls 120 can be dictated by the shapes of scissor arms 180, 190. In some embodiments, the pressure reduction at second pair of pressure rolls 130 is activated after the pressure reduction at first pair of pressure rolls 120. In other embodiments, the pressure reduction at both pairs of pressure rolls is simultaneous, or the pressure is reduced at second pair of pressure rolls 130 first.

As cam mechanism 150 continues to rotate, crease blade 110 is moved to the position shown in FIG. 4.

In FIG. 4, crease blade 110 is shown in the stop position where it does not contact sheets 300. Crease blade 110 is held in this position until sheets 300 are clear of the pressure rolls. After sheets 300 (in the form of a booklet) have cleared the pressure rolls, cam mechanism 150 begins to rotate to return to the position shown in FIG. 2, which releases lever 140 and permits full pressure to be restored at the pressure rolls.

FIGS. 5 and 6 show partial views of an assembly in accordance with another embodiment of the disclosure. This embodiment operates similarly to the embodiment shown in FIGS. 2-4, but has fewer parts and uses a lever 140' that is shaped differently.

FIG. 6 shows in closer detail how the movement of lever 140' pushing pin 200 downward causes first scissor arm 180 to lift the upper roll of first pair of pressure rolls 120 upward in direction B. Similarly, the movement of lever 140' pushing pin 200 downward causes second scissor arm 190 to lift the upper roll of second pair of pressure rolls 130 upward in direction B.

Figure 7:
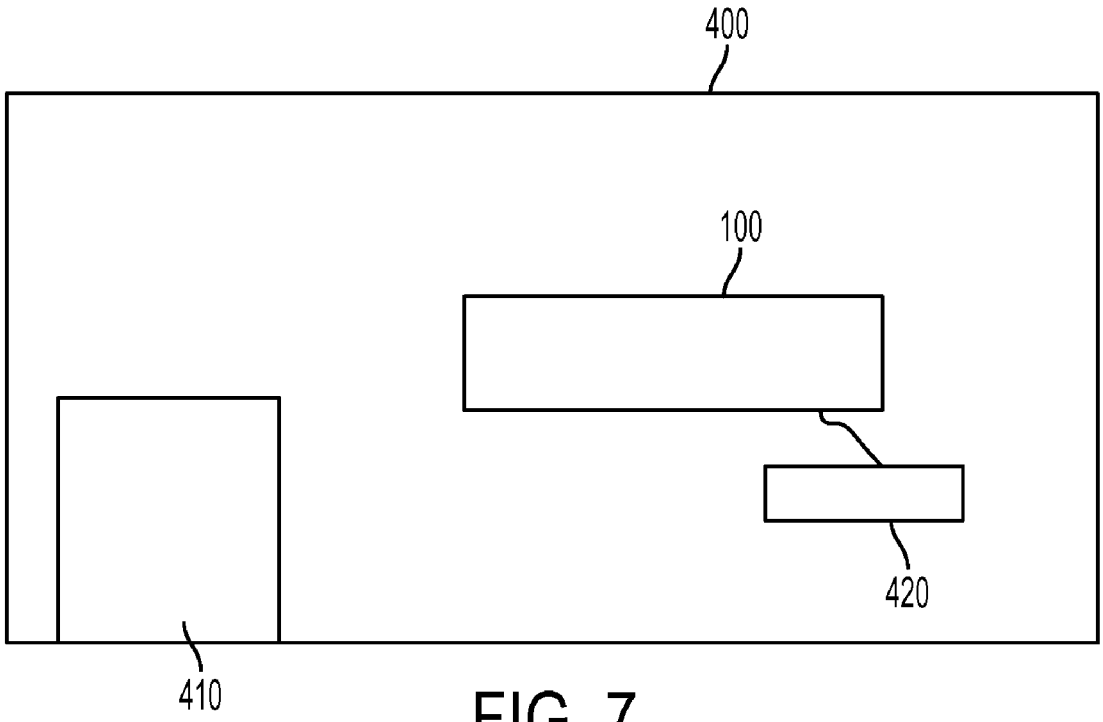
FIG. 7 is an exemplary schematic diagram of a printing device in accordance with one possible embodiment of the disclosure.

FIG. 7 shows a printing device 400 including assembly 100, a medium storage area 410, and a controller 420. Controller 420 controls the operation of assembly 100. Sheets 300 are stored in medium storage area 410 prior to processing through assembly 100.

Particular ones of the exemplary embodiments described herein can be used in any machine that folds printed sheets. However, blocking is particularly problematic in machines that print in color.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A device for folding sheets of a medium, comprising:

a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm; and a crease blade for contacting the sheets to create a crease in the sheets, wherein rotation of the cam mechanism through a first period of rotation causes the crease blade to move in a contact direction to create the crease in the sheets by pushing the sheets between the first rolls, and rotation of the cam mechanism through a second period of rotation causes the crease blade to move in a retracting direction away from the sheets and causes the lever to move the first and second scissor arms such that the first pair of rolls is separated and the second pair of rolls is separated.

2. The device of claim 1, wherein the cam mechanism causes the crease blade to move in the contact direction to a maximum insertion point where the crease blade and the sheets are positioned in between the first rolls.

3. The device of claim 2, wherein the maximum insertion point is a point at which between approximately 5 mm and approximately 6 mm of the sheets are inserted into a gap between the first rolls.

4. The device of claim 2, wherein the rotation of the cam mechanism is stopped for a period of time after the crease blade has moved in the retracting direction to a maximum retract point.

5. The device of claim 2, further comprising a motor that drives the cam mechanism, wherein the motor stops the rotation of the cam mechanism for a period of time after the crease blade has moved in the retracting direction to a maximum retract point, the maximum retract point being a point at which the entire crease blade is located outside a position between the first rolls.

6. The device of claim 1, wherein the first scissor arm pivots about a pivot shaft that is attached to the frame, and the second scissor arm pivots about the pivot shaft.

7. The device of claim 6, further comprising a pin that is attached to the frame and is movable relative to the frame in a translatory manner, wherein the pin contacts the first scissor arm and contacts the second scissor arm, and the lever arm actuates the first scissor arm and the second scissor arm by moving the pin in the translatory manner such that the pin moves the first scissor arm and moves the second scissor arm.

8. A printing device, comprising:

a medium storage area;

a folding device for folding sheets of a medium being printed, the folding device having a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm; and a crease blade for contacting the sheets to create a crease in the sheets; and a controller that controls rotation of the cam mechanism, wherein rotation of the cam mechanism through a first period of rotation causes the crease blade to move in a contact direction to create the crease in the sheets by pushing the sheets between the first rolls, and rotation of the cam mechanism through a second period of rotation causes the crease blade to move in a retracting direction away from the sheets and causes the lever to move the first and second scissor arms such that the first pair of rolls is separated and the second pair of rolls is separated.

9. The device of claim 8, wherein the cam mechanism causes the crease blade to move in the contact direction to a maximum insertion point where the crease blade and the sheets are positioned in between the first rolls.

10. The device of claim 9, wherein the maximum insertion point is a point at which between approximately 5 mm and approximately 6 mm of the sheets are inserted into a gap between the first rolls.

11. The device of claim 9, wherein the rotation of the cam mechanism is stopped for a period of time after the crease blade has moved in the retracting direction to a maximum retract point.

12. The device of claim 9, further comprising a motor that drives the cam mechanism, wherein the motor stops the rotation of the cam mechanism for a period of time after the crease blade has moved in the retracting direction to a maximum retract point, the maximum retract point being a point at which the entire crease blade is located outside a position between the first rolls.

13. The device of claim 8, wherein the first scissor arm pivots about a pivot shaft that is attached to the frame, and the second scissor arm pivots about the pivot shaft.

14. The device of claim 13, further comprising a pin that is attached to the frame and is movable relative to the frame in a translatory manner, wherein the pin contacts the first scissor arm and contacts the second scissor arm, and the lever arm actuates the first scissor arm and the second scissor arm by moving the pin in the translatory manner such that the pin moves the first scissor arm and moves the second scissor arm.

* * * * *